US011821702B2

(12) United States Patent
Septfons et al.

(10) Patent No.: US 11,821,702 B2
(45) Date of Patent: Nov. 21, 2023

(54) DEVICE FOR GUIDING A RECOILING MASS BY A MEMBER OF AN ELASTIC LINK

(71) Applicant: NEXTER SYSTEMS, Versaille (FR)

(72) Inventors: Pierre Septfons, Bourges (FR); Patrick Balbo, Bourges (FR)

(73) Assignee: NEXTER SYSTEMS, Versailles (FR)

( * ) Notice: Subject to any disclaimer, the term of this patent is extended or adjusted under 35 U.S.C. 154(b) by 0 days.

(21) Appl. No.: 17/918,841

(22) PCT Filed: May 3, 2021

(86) PCT No.: PCT/IB2021/053690

§ 371 (c)(1),
(2) Date: Oct. 13, 2022

(87) PCT Pub. No.: WO2021/224763

PCT Pub. Date: Nov. 11, 2021

(65) Prior Publication Data

US 2023/0184506 A1 Jun. 15, 2023

(30) Foreign Application Priority Data

May 4, 2020 (FR) ..... 2004167

(51) Int. Cl.
*F41A 25/22* (2006.01)

(52) U.S. Cl.
CPC ..... *F41A 25/22* (2013.01)

(58) Field of Classification Search
CPC ..... F41A 25/26; F41A 25/22; F41A 25/24; F41A 25/02; F41A 25/04
USPC ..... 89/163, 162, 160, 198, 199, 14.3
See application file for complete search history.

(56) References Cited

U.S. PATENT DOCUMENTS 1,754,943 A * 4/1930 Hammar ..... F41A 25/24 89/43.01
4,269,109 A * 5/1981 Stoner ..... F41A 3/82 89/44.01
4,785,922 A * 11/1988 Kiehart ..... F41A 25/02 277/467

(Continued)

FOREIGN PATENT DOCUMENTS

DE 1 097 318 B 1/1961
EP 0 321 345 A1 6/1989

(Continued)

OTHER PUBLICATIONS

Jan. 14, 2021 Search Report issued in French Patent Application No. 2004167.

(Continued)

*Primary Examiner* — John Cooper
(74) *Attorney, Agent, or Firm* — Oliff PLC

(57) ABSTRACT

A weapon system includes a recoiling mass and a cradle, the recoiling mass including a weapon barrel and a breech ring and translating relative to the cradle during firing, and a guide device being provided for guiding this recoil movement of the recoiling mass. This weapon system is characterized in that the guide device includes at least one member of an elastic link, the body of which is secured to the recoiling mass and includes a prismatic external profile cooperating with a complementary rail secured to the cradle.

9 Claims, 3 Drawing Sheets

(56) References Cited

U.S. PATENT DOCUMENTS

| | | | | |
|---|---|---|---|---|
| 4,991,490 | A | 2/1991 | Balbo et al. | |
| 5,703,318 | A * | 12/1997 | Franchino | F41A 25/22 89/36.02 |
| 5,767,436 | A | 6/1998 | Sanderson et al. | |
| 6,347,568 | B1 * | 2/2002 | Soulaigre | F41A 25/22 89/42.01 |
| 2012/0266747 | A1 * | 10/2012 | Wynes | F41A 5/36 89/43.01 |

FOREIGN PATENT DOCUMENTS

| | | | |
|---|---|---|---|
| EP | 0 747 651 | A1 | 12/1996 |
| EP | 1 072 857 | A1 | 1/2001 |
| FR | 2 679 990 | A1 | 2/1993 |
| WO | 2009/049720 | A1 | 4/2009 |

OTHER PUBLICATIONS

Jan. 14, 2021 Written Opinion issued in French Patent Application No. 2004167.

Aug. 13, 2021 International Search Report issued in International Patent Application No. PCT/IB2021/053690.

Aug. 13, 2021 Written Opinion of the International Searching Authority issued in International Patent Application No. PCT/IB2021/053690.

* cited by examiner

DEVICE FOR GUIDING A RECOILING MASS BY A MEMBER OF AN ELASTIC LINK

The invention relates to a weapon system comprising a recoiling mass and a cradle.

The recoiling mass of a weapon typically comprises a weapon barrel, which is equipped at its rear part with a breech ring.

The breech ring carries the breech, which closes the barrel after the piece of ammunition has been loaded. The breech may be a wedge breech or a screw breech.

During firing, the recoiling mass translates relative to the cradle to allow the recoil of the weapon barrel after the piece of ammunition has been fired.

It is therefore necessary to provide a means for guiding this recoil.

Patent EP 1,072,857 describes an example of a guide means comprising prismatic shoes that are secured to the cradle and slide in corresponding grooves carried by a carriage to which the weapon barrel is fixed.

The disadvantage of such a solution is that a carriage must be fitted to the recoiling mass, which affects the bulk of the weapon system.

In addition, in order to reduce the recoil forces and recoil length, it is necessary to give a large mass to the recoiling mass.

Patent application US 2012/0266747 A1 is another example of the implementation of such a carriage, and in particular describes a weapon system with damped recoil comprising a recoiling mass that slides relative to a cradle, the recoiling mass comprising a weapon barrel and a breech, there being provided a pair of recoil brakes, secured to the cradle and connected to one another by brackets. The recoiling mass is guided relative to the cradle by means of bars that are secured to the cradle and receive rails carried by a carriage secured to the weapon barrel.

U.S. Pat. No. 5,767,436 describes another example of a guide means for guiding the sliding of a medium-caliber weapon relative to a cradle, said guide means comprising recoil boxes guided by rails secured to the cradle. In particular, guiding is provided by rollers that are secured to the rails and roll on walls of each box, the rollers passing through the rails through openings provided in the latter. The boxes are also transversely crossed by rods at openings, said rods limiting the recoil movement.

Application WO 2009/049720 A1 describes a medium-caliber weapon mounting in which the recoiling mass is guided relative to the cradle by tongues running in grooves.

Patent DE1097318 B describes a guide means for guiding a weapon barrel relative to a cradle, guiding being achieved by means of guide profiles cooperating with tongues secured to the weapon.

It is the aim of the invention to propose a weapon system in which both the recoil forces are reduced and the mass of the cradle is reduced.

This makes it possible for the weapon system to be lighter with reduced forces at the trunnions.

Thus, the invention relates to a weapon system comprising a recoiling mass and a cradle, the recoiling mass comprising a weapon barrel and a breech ring and translating relative to the cradle during firing, and a guide means being provided for guiding this recoil movement of the recoiling mass, characterized in that the guide means comprises at least one member of a resilient link, the body of the at least one member being secured to the recoiling mass and comprising a prismatic external profile cooperating with a complementary rail secured to the cradle, and the rod of the at least one member being slidably mounted in said body, the cradle comprising a ring in which the weapon barrel slides, the ring carrying, at a front part, an end plate on which the rod of the at least one member is fixed and, at a rear part, an end plate carrying the complementary rail on which the body of the at least one member slides.

According to a particular embodiment, the member forming part of the guide means may be a hydraulic or pneumatic recuperator.

According to a particular embodiment, the weapon system may comprise two symmetrical recuperators, arranged on either side of the breech ring.

Advantageously, the breech ring may be connected to the cradle by two pairs of hydraulic or pneumatic recoil brakes, each recuperator being arranged between two brakes of the same pair.

Advantageously, the rods of the recoil brakes may be fixed to the end plate of the cradle.

According to another particular embodiment, the member forming part of the guide means is at least two hydraulic or pneumatic recoil brakes. The elastic link may also comprise two hydraulic or pneumatic recuperators, which are symmetrical and arranged on either side of the breech ring, the body of each recuperator being secured to the recoiling mass and the rod of each recuperator being fixed to the end plate.

The prismatic external profile may comprise at least two pairs of bearing surfaces each delimiting a V shape, the two V shapes being positioned facing each other.

Symmetrically, the complementary rail may comprise at least two pairs of complementary bearing surfaces each delimiting a V shape, the two V shapes being positioned facing each other.

The invention will be better understood upon reading the following description of a particular embodiment, the description being made with reference to the attached drawings in which.

Figure 1:
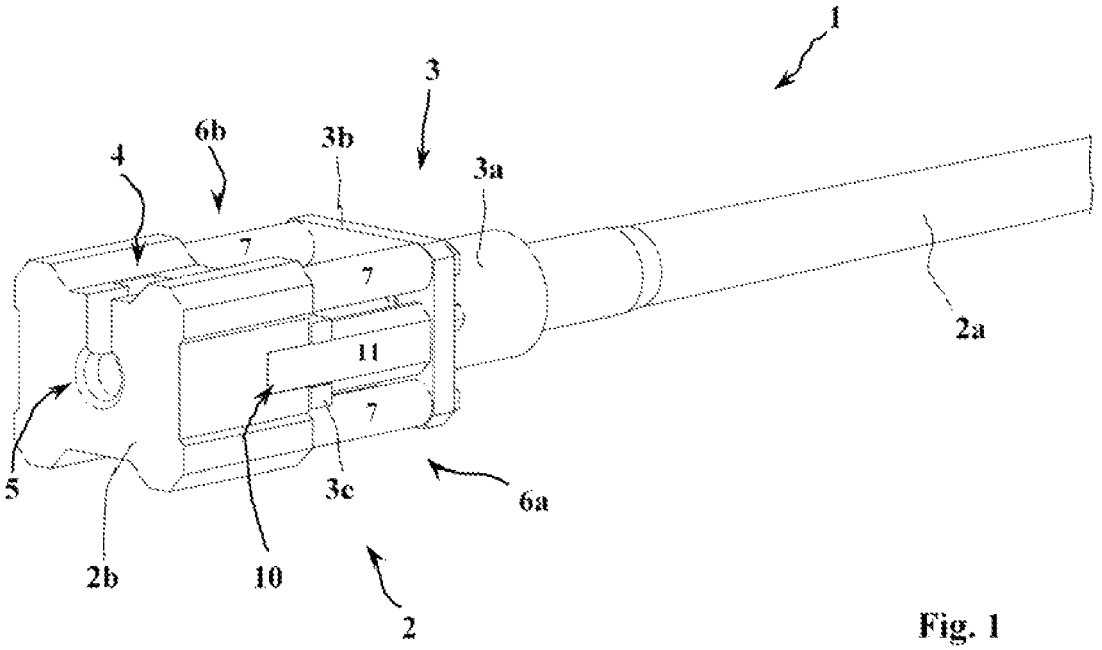
FIG. 1 shows a rear perspective of a weapon system according to one embodiment of the invention, with the recoiling mass in the return to battery position.
Figure 2:
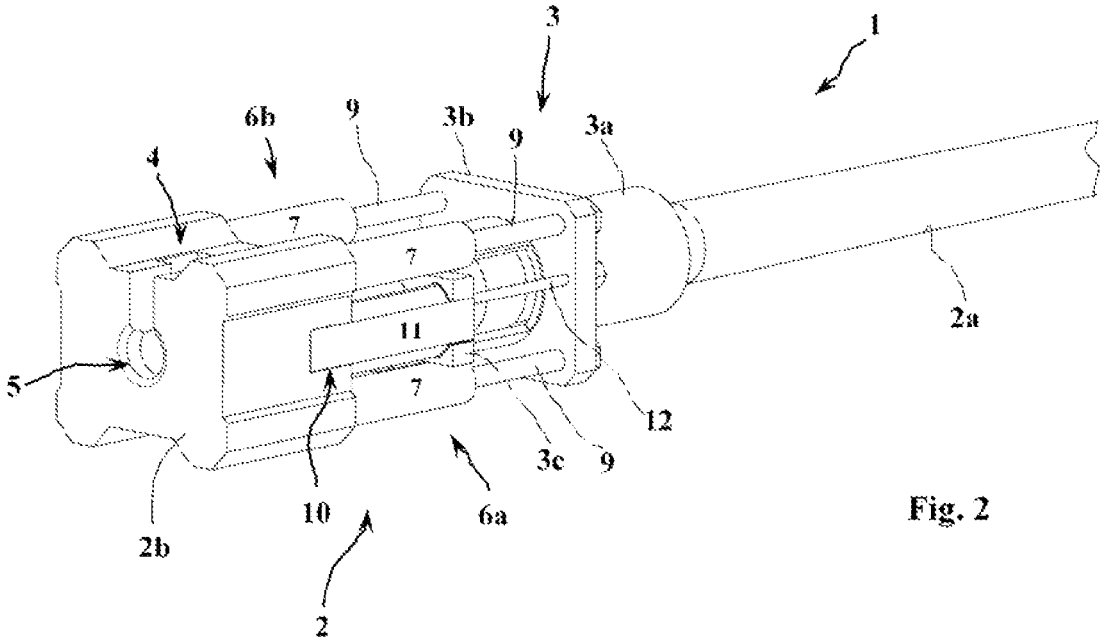
FIG. 2 shows a rear perspective of the same weapon system, with the recoiling mass in the maximum recoil position.

Referring to FIGS. 1 and 2, a weapon system 1 according to one embodiment of the invention comprises a recoiling mass 2 and a cradle 3.

This weapon system is for example intended to equip an armored vehicle, which is not shown, for example a tank.

The cradle 3 is connected to the turret of the vehicle by a system of trunnions (not shown) allowing the weapon system to be aimed in elevation. These mountings are conventional and are therefore not shown here.

In a similarly conventional manner, the recoiling mass 2 comprises a weapon barrel 2*a* to which a breech ring 2*b* is fixed. For example, the weapon barrel 2*a* will be of a large caliber, such as a barrel with a caliber greater than 105 mm.

The breech ring 2*b* that is shown is a ring that carries a breech wedge slidably mounted in a transverse opening 4. An axial hole 5 allows the barrel to be loaded with a piece of ammunition.

Wedge breeches are well known to the one skilled in the art, for example by patents EP747,651 and EP321,345, and it is not necessary to describe them in detail.

It would also be possible to provide a breech ring with a screw breech of the type described for example in patent FR2,679,990.

Figure 5:
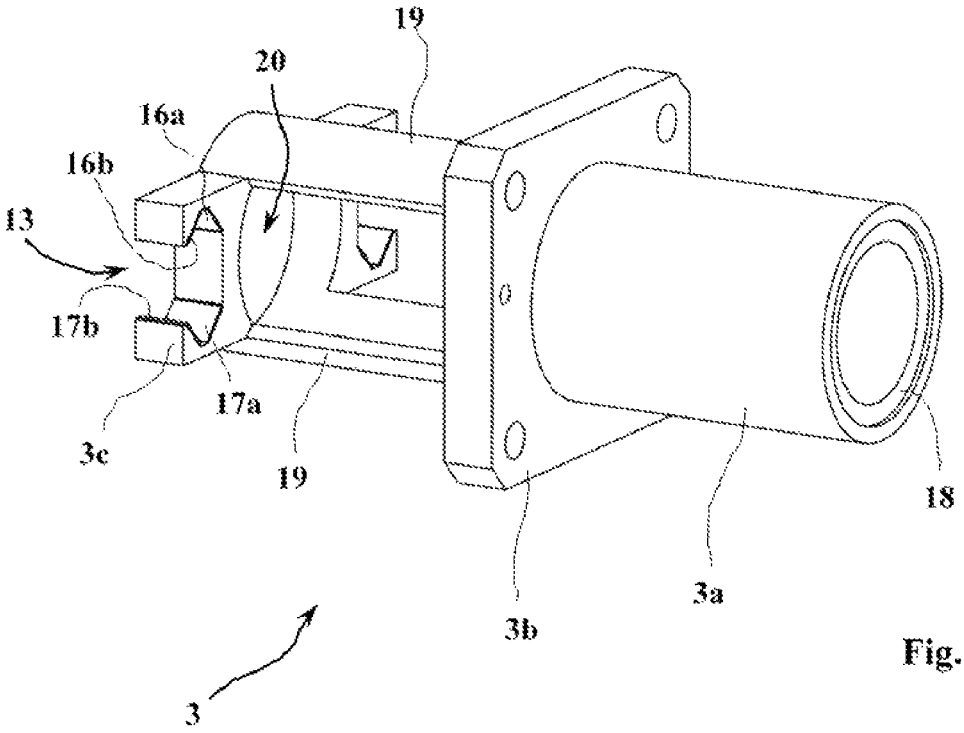
FIG. 5 is a perspective view of the cradle alone.

As it can be seen in the Figures, and in particular in FIG. 5, the cradle 3 has a ring 3*a* in which the weapon barrel 2*a* slides. In order to facilitate the sliding of the barrel, the ring 3*a* carries an inner bushing 18 made of a material that reduces friction, for example brass.

The ring 3*a* carries at a front part an end plate 3*b* and at a rear part an end plate 3*c*. The end plate 3*c* is connected to the end plate 3*b* by two cheeks 19 in the form of cylinder portions whose internal diameter is greater than that of the weapon barrel 2*a*. The cheeks 19 and the end plate 3*c* delimit a circular opening 20 which allows the weapon barrel 2*a* to pass therethrough.

The breech ring 2*b* is connected to the cradle 3 by an elastic link that comprises recoil brakes 7 and recuperators 10. Hydraulic recoil brakes 7 are well known and generally comprise a piston moving in a cylinder and causing a fluid, usually oil, to be expelled. The throttling of the oil causes braking. Pneumatic brakes are also known, but the braking efficiency is lower.

The function of the recuperators 10 is to return to battery the recoiling mass 2 after its recoil. When the brake is hydraulic, the fluid expelled from the brake is led through pipes to the recuperator where it compresses a gas whose expansion will lead to the return to battery of the recoiling mass.

The weapon system 1 shown in the Figures here comprises two pairs 6*a*, 6*b* of hydraulic or pneumatic recoil brakes 7. The body 8 of each brake 7 is secured to the breech ring 2*b*, for example by screwing or shrink-fitting. The rod 9 of each recoil brake is fixed, for example by screwing, to the end plate 3*b* of the cradle 3 (FIG. 2).

As it can be seen in the Figures, a recuperator 10 is arranged between two brakes 7 of a pair 6*a* or 6*b* of recoil brakes.

There are thus two recuperators 10, one arranged at each side face of the ring 2*b*. The body 11 of each recuperator 10 is secured to the ring 2*b*, for example by screws (not shown).

The rods 12 of the recuperator are fixed, for example by screwing, to the end plate 3*b* of the cradle 3.

It can be seen that the recoiling mass 2 also comprises the mass of the brake bodies 8 and that of the recuperator bodies 11.

This increases the overall mass of the recoiling mass 2, which reduces both the recoil forces and the recoil length. Such an arrangement is favorable to an integration in the turret of an armored vehicle and to an overall reduction in the mass of the weapon system, the cradle of which no longer has to be oversized.

Figure 3:
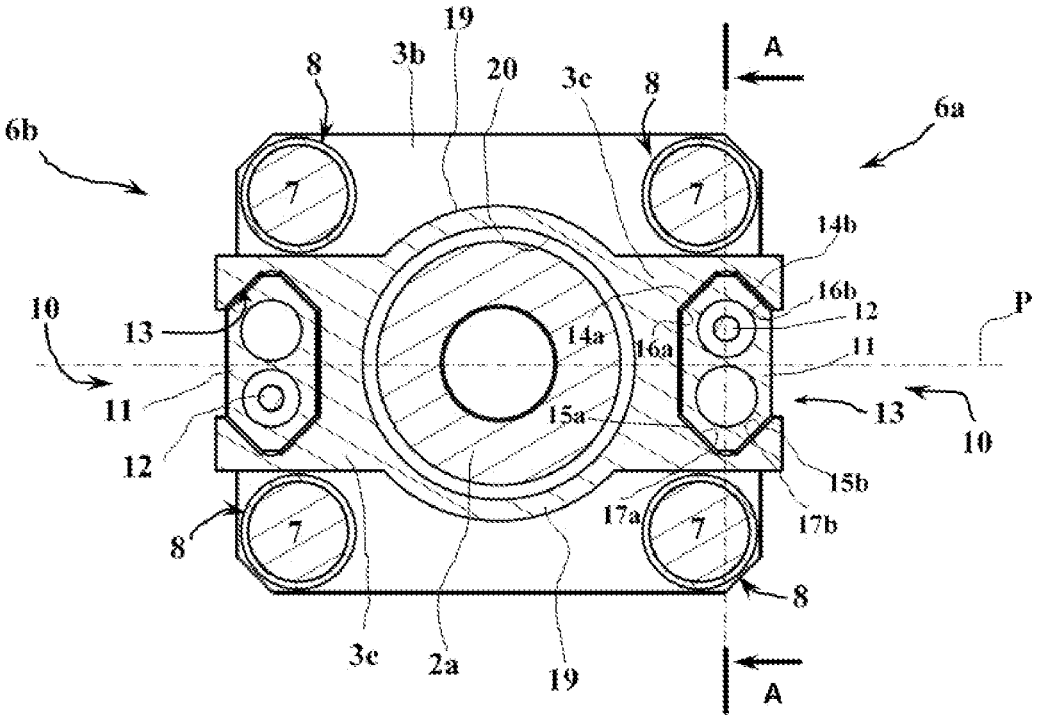
FIG. 3 is a cross-sectional view of the weapon system according to this embodiment of the invention, the section being made along the plane whose trace BB is indicated in FIG. 4.
Figure 4:
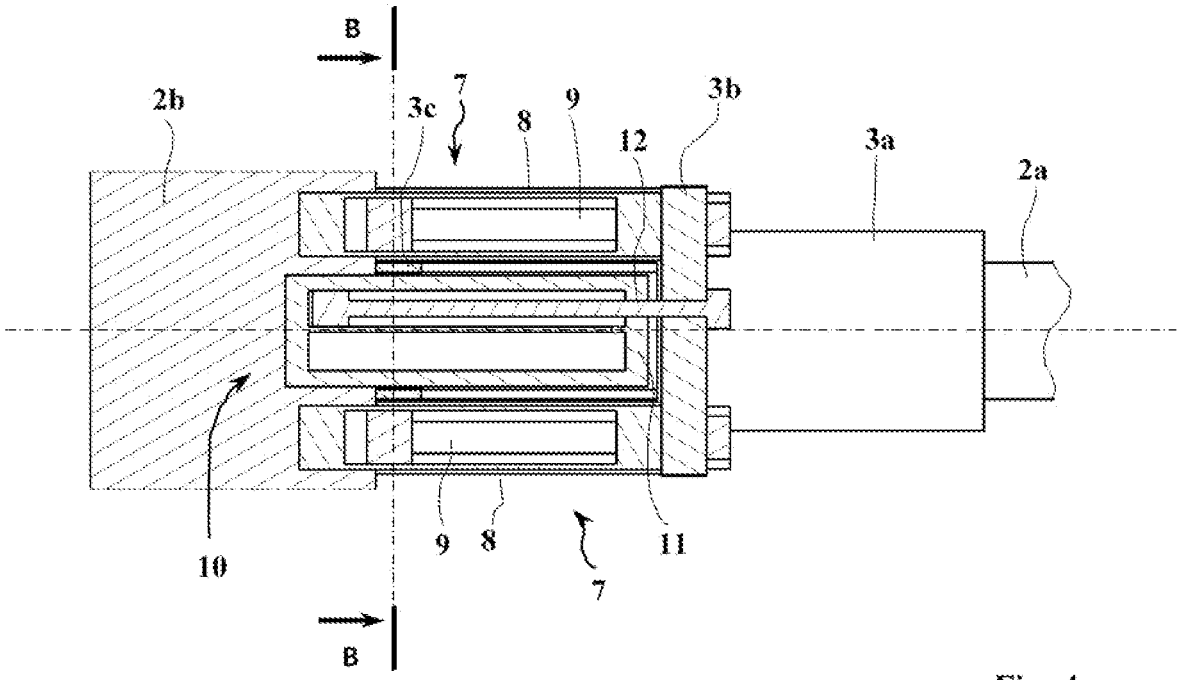
FIG. 4 is a longitudinal view of the weapon system according to this embodiment of the invention, the section being made along the plane whose trace AA is indicated in FIG. 3.

As it can be seen in FIG. 3, the body 11 of each recuperator 10 has a prismatic external profile that cooperates with a complementary rail 13 secured to the cradle 3.

A prismatic external profile is a polyhedron shape based on two equal and parallel polygons whose homologous sides are joined by parallelograms.

In simple terms, a prismatic shape has a non-circular section and whose section is constant along the prism. It therefore allows sliding along the axis of the prism (the line connecting the barycenters of the two equal and parallel bases) and prohibits any rotation around the axis of the prism. A rectangular parallelepiped is a prism (rectangular base). A block whose section is a regular or non-regular hexagon (as shown in the figures) is also a prism.

The complementary rails 13 are secured to the end plate 3*c* of the cradle 3.

It can be seen on FIG. 3 that the prismatic external profile of each recuperator body 11 comprises two pairs of bearing surfaces 14*a*, 14*b* and 15*a*, 15*b*. Each pair of bearing surfaces delimits a V shape and the V shape formed by the bearing surfaces 14*a* and 14*b* is positioned facing the V shaped formed by the bearing surfaces 15*a* and 15*b*. The two V shapes are symmetrical with respect to a plane P passing through the middle of the bodies 11 of the recuperators 10 and which contains the axis of the weapon barrel.

Similarly, the complementary rail 13 that receives the recuperator body 11 comprises two pairs of bearing surfaces complementary to the bearing surfaces of the recuperator body 11.

The rail 13 thus comprises two pairs of bearing surfaces 16*a*, 16*b* and 17*a*, 17*b*. Each pair of bearing surfaces delimits a V shape and the V shape formed by the bearing surfaces 16*a* and 16*b* is arranged facing the V shape formed by the bearing surfaces 17*a* and 17*b*. The two V shapes are symmetrical with respect to the plane P passing through the middle of the rails 13.

The recoiling mass 2 translates from the cradle 3 during firing due to the recoil effect.

The translation movement is guided, on the one hand, by the cooperation of a cylindrical bearing of the weapon barrel 2*a* with the ring 3*a* of the cradle 3 and, on the other hand, by the sliding of the two bodies 11 of the recuperators 10 on the rails 13 which are secured to the end plate 3*c* of the cradle 3, behind the ring 3*a*.

It can be seen that the guide means here are particularly compact and that it is not necessary to provide additional rails on either side of the recoiling mass.

The structure of the recoiling mass incorporates the guide means formed by the bodies 11 of the recuperators 10. No dedicated carriage is required, as the breech ring 2*b* carries all the guide means.

A prismatic guide made by the recuperator bodies 10 has been described here.

It would also be possible to define a weapon system in which guiding would be provided at the body of at least two of the firing brakes 7. Of course, the guiding bodies would then be prismatic in shape to enable them to fulfil their function.

The invention claimed is:

1. Weapon system comprising a recoiling mass and a cradle, the recoiling mass comprising a weapon barrel and a breech ring and being arranged to translate with a recoil movement relative to the cradle during firing, and a guide means being provided for guiding this recoil movement of the recoiling mass, wherein the guide means comprises at least one member of an elastic link, a body of the at least one member being secured to the recoiling mass and comprising a prismatic external profile cooperating with a complementary rail secured to the cradle, and a rod of the at least one member being slidably mounted in said body, the cradle comprising a ring in which the weapon barrel slides, the ring carrying, at a front part, a first end plate on which the rod of the at least one member is fixed and, at a rear part, a second end plate carrying the complementary rail on which the body of the at least one member slides.

2. The weapon system according to claim 1, wherein the member forming part of the guide means is a hydraulic or pneumatic recuperator.

3. The weapon system according to claim 2, wherein the weapon system comprises two symmetrical recuperators, arranged on either side of the breech ring.

4. The weapon system according to claim 3, wherein the breech ring is connected to the cradle by two pairs of hydraulic or pneumatic recoil brakes, each recuperator being arranged between two recoil brakes of a same pair.

5. The weapon system according to claim 4, wherein rods of the recoil brakes are fixed to the first end plate of the cradle.

6. The weapon system according to claim 1, wherein the member forming part of the guide means is at least two hydraulic or pneumatic recoil brakes.

7. The weapon system according to claim 6, wherein the elastic link comprises two hydraulic or pneumatic recuperators, which are symmetrical and arranged on either side of the breech ring, a body of each recuperator being secured to the recoiling mass and a rod of each recuperator being fixed to the first end plate.

8. The weapon system according to claim 1, wherein the prismatic external profile comprises at least two pairs of bearing surfaces each delimiting a V shape, the two V shapes being positioned facing each other.

9. The weapon system according to claim 8, wherein the complementary rail comprises at least two pairs of complementary bearing surfaces each delimiting a V shape, the two V shapes being positioned facing each other.

* * * * *